US005174682A

United States Patent [19]

Whitfield

[11] Patent Number: 5,174,682

[45] Date of Patent: Dec. 29, 1992

[54] MINE VENTILATION OVERCAST

[75] Inventor: Ronald D. Whitfield, Madisonville, Ky.

[73] Assignee: Modern Welding Company, Inc., Owensboro, Ky.

[21] Appl. No.: 775,492

[22] Filed: Oct. 15, 1991

[51] Int. Cl.[5] ..... E21D 9/00; E21F 1/00

[52] U.S. Cl. ..... 405/132; 454/168

[58] Field of Search ..... 405/124, 126, 132, 153, 405/288; 98/50

[56] References Cited

U.S. PATENT DOCUMENTS 1,535,162 4/1925 Kime ..... 405/124

2,729,065 1/1956 Craggs et al. ..... 405/132

2,729,066 1/1956 Kennedy et al. ..... 405/132

4,484,837 11/1984 Kennedy et al. ..... 405/132

4,621,951 11/1986 Dewson ..... 405/132 X

*Primary Examiner*—David H. Corbin

[57] ABSTRACT

An overcast serving utility in the ventilation of tunnelways in an underground mine defined by an erected frame, typically made from steel, and including pivoting clips and splice strips for ready assembly and, as well, the absence of comingling of uncontaminated and contaminated air. The invention simplifies the approach for passing new air into the mining area and permitting contaminated air flowing through lateral tunnelways to pass over the overpass.

13 Claims, 3 Drawing Sheets

MINE VENTILATION OVERCAST

BACKGROUND OF THE INVENTION

As is known, the ventilation of passageway and/or tunnelways in an underground mine, such as for coal, presents a serious need. Usually, the aforesaid passageways are defined by a grid pattern established by pillars of coal dependent, in part, upon the height of a given seam. As coal is mined, the mining activity becomes more distant from the source of ventilation and, accordingly, it is desirable to selectively pass contaminated air over intersecting air inlet passageways to exhaust.

Importance lies in the fact that there should be no intermingling of the incoming fresh air with the contaminated air passing to outlet, where the latter is being drawn from the mining area, typically, by reason of exhaust fans or the like. The aforesaid intercomingling of air has been prevented heretofore by the use of permanent barriers, such as those erected from concrete block or the like, which serve to define the passageway for the incoming air.

DESCRIPTION OF THE INVENTION

The invention presents an overcast which is readily assembled at a use site in the tunnel area of a mine, being made from steel and including pivoting clips and splice strips for ready assembly and, as well, the absence of comingling with contaminated air.

Typically, a complete installation includes an erected frame in combination with outward angling concrete block wall sections at each corner, the latter extending to the roof of the passageway, and, further, a concrete block wall extending along the front and rear edge of the framework, also to the roof of the mined tunnelway.

In other words, the invention simplifies the approach for passing new air into the mining area and permits contaminated air, flowing through lateral passageways, to pass over the overcast. Restated otherwise, the overcast herein, being simple to erect, and readily modifiable to space requirements, prevents any interference between flowing air paths from front located blowers to exhaust fans.

The overcast itself is defined by side walls and a roof made from metal panelling and defined by independent sections, assembled, from front to rear, by tie rod and collars staggered from section to section.

DESCRIPTION OF THE FIGURES

In any event, a better understanding of the present invention will become more apparent from the following description, taken in conjunction with the accompanying drawings, wherein.

Figure 1:
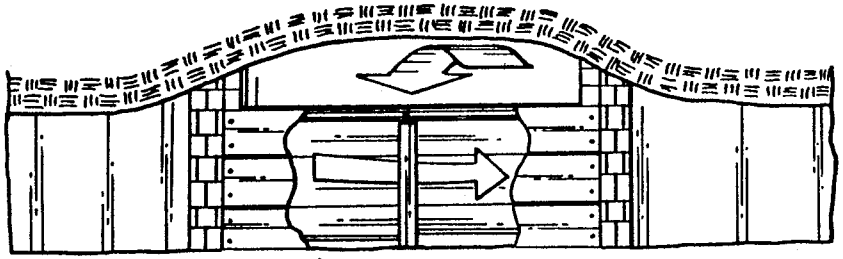
FIG. 1 is a view in side elevation showing an overcast in accordance with the teachings of the present invention in a typical installation, with the arrows depicting air flow within the overcast in the incoming air passageway and over the overcast in a lateral return passageway.

For the purposes of promoting an understanding of the principles of the invention, reference will now be made to the embodiment illustrated in the drawings and specific language will be used to describe the same. It will nevertheless be understood that no limitations of the scope of the invention is thereby intended, such alterations and further modifications in the illustrated device, and such further applications of the principles of the invention as illustrated therein being contemplated as would normally occur to one skilled in the art to which the invention relates.

DESCRIPTION OF THE PREFERRED EMBODIMENT

Figure 2:
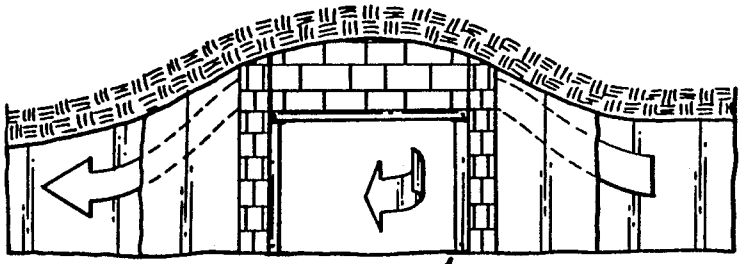
FIG. 2 is another view in elevation, looking from right to left in FIG. 1, again illustrating, by arrows, air flow.
Figure 3:
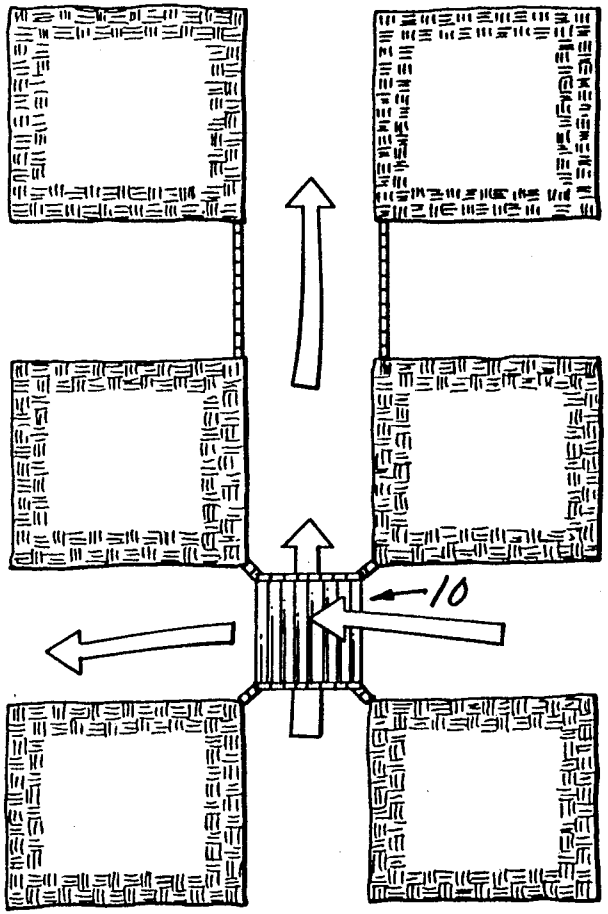
FIG. 3 is a top plan view of a typical tunnel and/or passageway grid pattern in an underground mine where, again, the arrows depict air flow.

Referring now to FIGS. 1, 2 and 3, the mine ventilation overcast 10 of the invention is shown as installed in a typical tunnel and/or passageway within an underground mine. FIG. 3 particularly recognizes the pillars of coal, arranged in a gridlike pattern, after mining has been accomplished, where, for example, the incoming uncontaminated air flows, in the direction of the arrows, i.e. from the bottom to the top side edges of the drawing panel.

The lateral passageways permit the flow of contaminated air, by blower action to exhaust. As evident also in FIGS. 1 and 2, the uncontaminated air flows through the overcast, while the contaminated air flows above the overcast.

In order to provide against any intermingling of flowing air, the instant overcast, fabricated from material and at the site, includes corners of concrete block or the like, each angling outwardly with engagement to a neighboring corner of a pillar. Concrete blocks are disposed on the upper front and rear edges of the framework of the overcast 10 into contact with the mine roof (see FIG. 2). In other words, the contaminated air flow path is contained above the overcast, while the uncontaminated air flow is through the overcast. Thus, mingling of the moving air masses is prohibited.

As evident in FIG. 3, an overcast 10 is not necessarily employed at the intersection of a principal passageway and each lateral passageway but, instead, complete air blockage is achieved through a wall of concrete blocks closing entry to and from a lateral passageway to the principal passageway. In other words, it is not necessary for lateral contaminated air flow to discharge at every lateral passageway.

Figure 4:
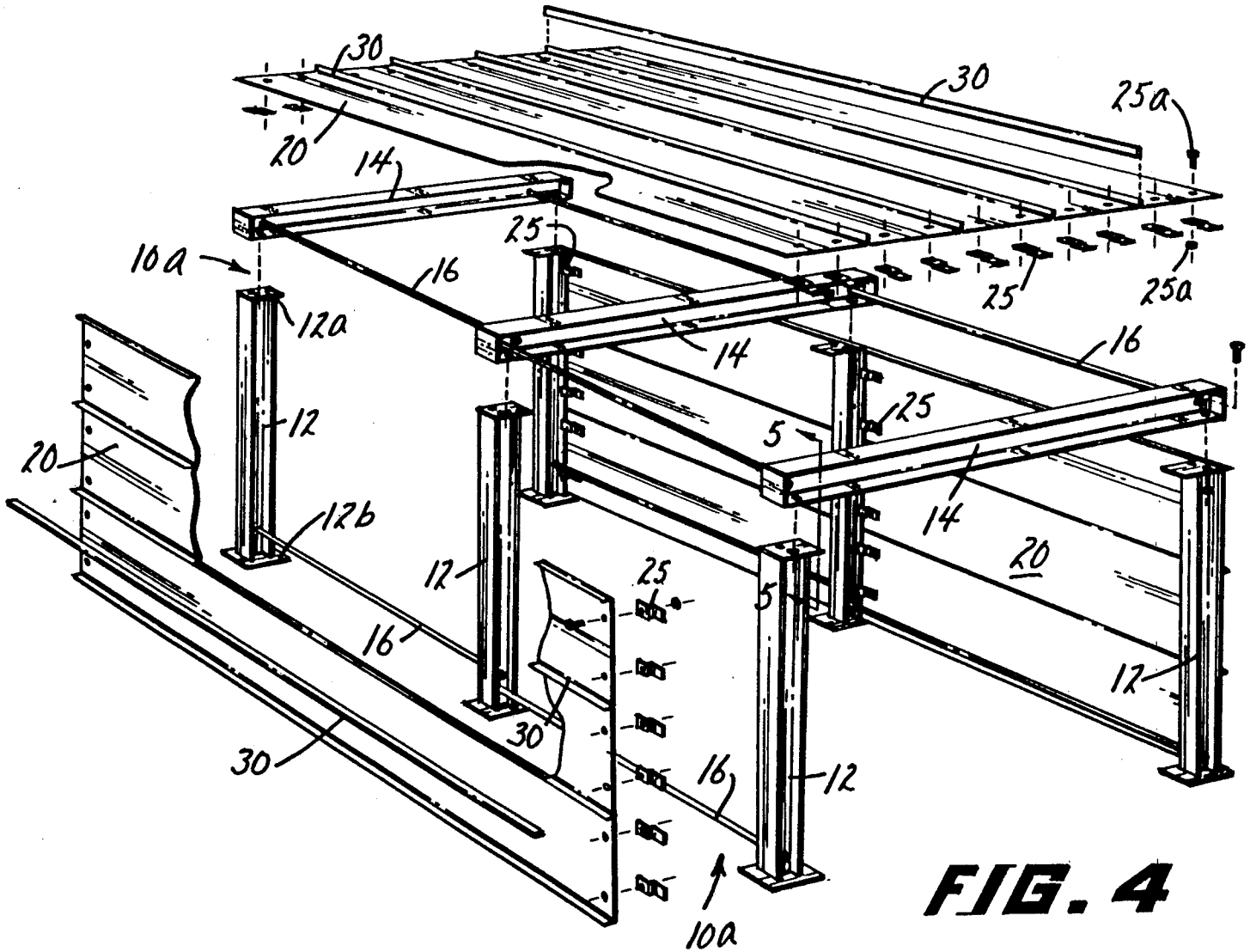
FIG. 4 is a perspective view, generally expanded for reasons of assembly clarity, detailing a mine ventilation overcast in accordance with the teachings of the invention.

FIG. 4 is important in the showing of the assembly of a typical overcast 10, generally achieved in sections 10*a*, which includes upstanding members 12 (having plate members 12*a*,12*b* at opposite ends, mounting cross members 14. The number of sections 10*a* employed, as well as all dimensioning, is dependent upon the size of the tunnel openings involved, where spacing between the cross members 14 is maintained by combinations of tie rods (not detailed) contained within collars 16. As evident, the latter are disposed at the free ends of the cross members 14 and proximate the bottom of the upstanding members 12. In order to achieve a rigid assembly, the tie rod-collar combinations are staggered, with respect to each other, from overcast section 10*a* to the next succeeding overcast section 10*a*.

Figure 5:
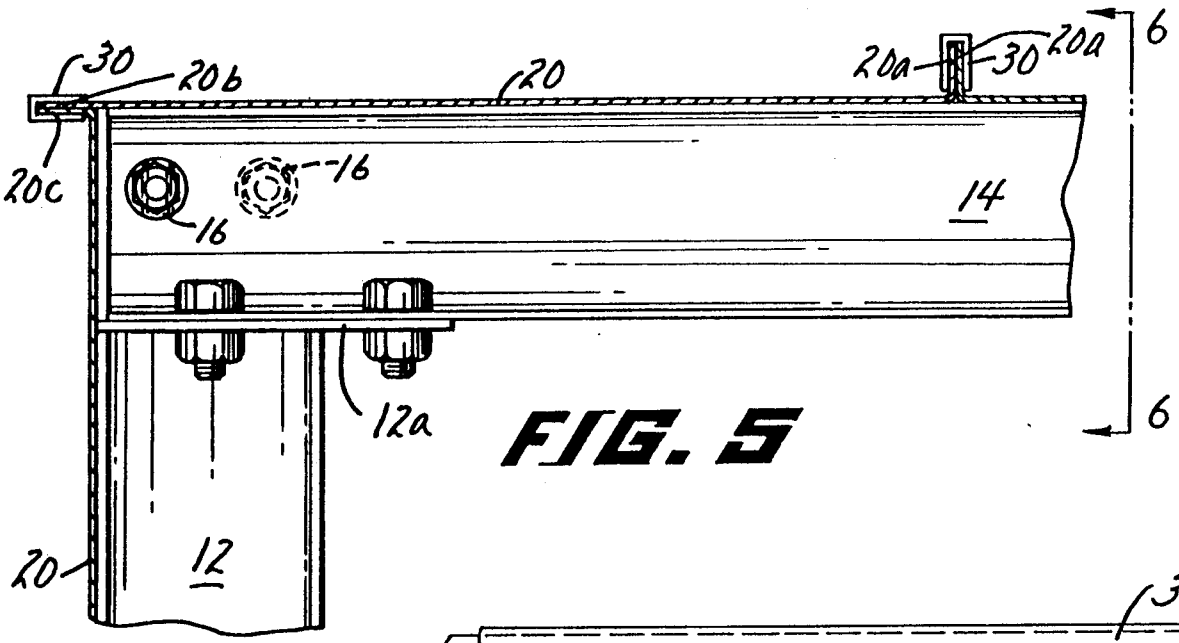
FIG. 5 is an enlarged view in elevation, taken at line 5—5 on FIG. 4 detailing a splice strip used in connection with the installation of an overcast; and, FIG. 6 is another view in elevation, taken at line 6—6 on FIG. 5 and looking in the direction of the arrows, detailing the employed pivoting clips.
Figure 6:
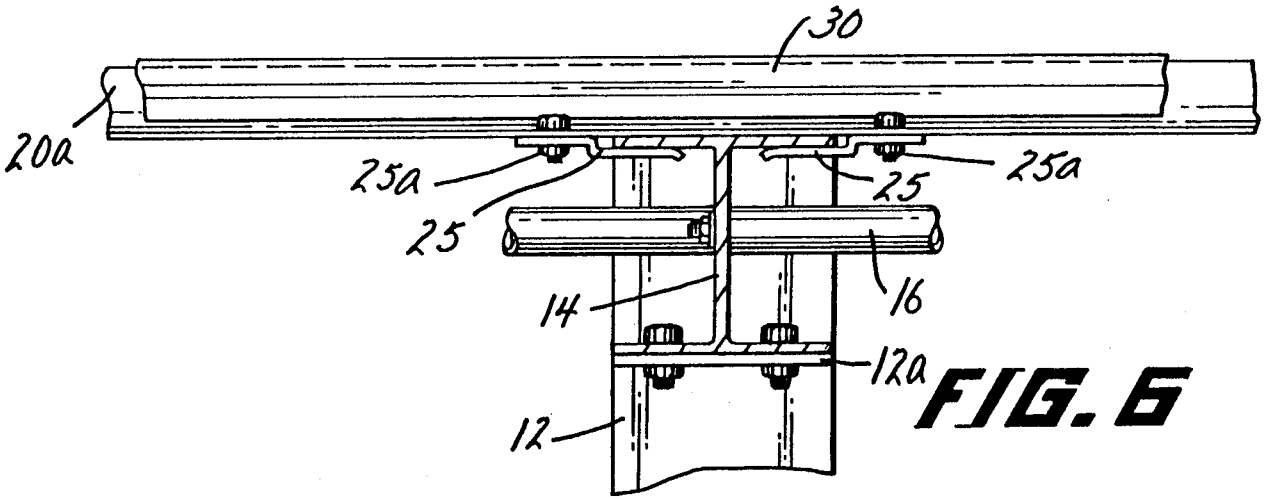

Panelling 20 is disposed on the cross members 14 and, as well, on outer surfaces of the upstanding members 12. Importantly, assembly is accomplished and perfected by pivoting clips 25 particularized in FIG. 6 and the splice strips 30 particularized in FIG. 5.

As to the former, each panel 20 is readily secured to a cross member 14 through pivotal action of clips 25, where the latter are secured to a panel through nut and bolt combinations 25*a*. A similar arrangement is provided for both the panels 20 presenting the roof or top of the overcast 10 and the side walls of the overcast 10, being particularly evident in the FIG. 4 showing (both prior to placement and after securement—see the inner surfaces of the panels 20 defining a side wall of the overcast).

As to the latter, a positive and further airtight relationship between adjacent panels 20 is accomplished through the usage of splice strips 30, such overlaying succeeding flanges 20*a* along the longitudinal edges of adjacent panels 20, including the extending outer edge 20*b* of a panel 20 employed for the roof and an outturned edge 20*c* of a panel 20 serving side wall purposes. The latter is evident not only in FIG. 5, but in FIG. 1, as well.

Thus, and from the preceding, it should be evident that the overcast of the invention is defined by a series of interchangable components, is readily assembled at an installation site, is maintained in an assembled relationship through the use of a plurality of pivoting clips 25 and an airtight feature through the use of splice strips 30 which also serve positive assembly purposes.

Use of the invention is implemented by, as stated heretofore, concrete blocks or like barrier material which eliminates mingling of uncontaminated air, to the extent that such concrete blocks are maintained on the cross members 14 at opposite ends of the overcast and extend into ceiling engagement with the roof of the mine. Thus, air flow is positively contained, i.e. with uncontaminated air flowing through the overcast and contaminated air flowing over the overcast. The invention simplifies what heretofore has been a major problem in underground mine ventilation, being readily erected at the desired installation site.

The mine ventilation overcast described hereabove is susceptible to various changes within the spirit of the invention, including, by way of example, in proportioning; the selection of material used for the roof and/or side panels; the manner of securing section to section; and, the like. Thus, the preceding should be considered illustrative and not as limiting the scope of the following claims.

I claim:

1. An overcast for usage at intersecting tunnels in an underground mine comprising upstanding support members, cross members mounted on said upstanding support members, and a plurality of panels directly overlying said upstanding support members and said cross members serving top and side walls, where clips pivotally secured to the inner surfaces of said panels selectively engage portions of said upstanding support members and said cross members in a fastening relationship.

2. The overcast of claim 1 where said panels include upstanding projections along the longitudinal edges of the outer surfaces of each, and where a splice strip overlies adjacent upstanding projections in an air tight relationship.

3. The overcast of claim 1 where barrier means maintained on end cross members extend between the latter and the roof of one of said intersecting tunnels to confine air flow above said overcast.

4. The overcast of claim 3 where barrier means proximate the corners of said overcast extend to the walls of an adjacent tunnel to confine air flow through the overcast.

5. The overcast of claim 3 where said air flow is contaminated air.

6. The overcast of claim 4 where said air flow is uncontaminated air.

7. The overcast of claim 1 where certain of said panels include upstanding projections along the longitudinal edges of the outer surfaces of each and other of said panels include extending projections along the longitudinal edges of each, and where a splice strip overlies adjacent upstanding and extending projections in an air tight relationship.

8. The overcast of claim 1 where barrier means used in combination therewith serve to permit passage of uncontaminated air through said overcast and contaminated air over said overcast.

9. The overcast of claim 8 where said barrier means selectively extend from opposite edges of said overcast into engagement with the roof of said tunnel.

10. The overcast of claim 8 where other of said barriers selectively extend from corners of said overcast into engagement with adjacent walls of said tunnel.

11. The overcast of claim 1 where said support members and said cross members define sections assembled by collar-tie rod combinations.

12. The overcast of claim 11 where successive collar-tie rod combinations are staggered with relation to each other.

13. The overcast of claim 1 where said support members each present a top plate, and where said cross members are secured to said top plate in an assembled relationship.

* * * * *